US009403054B1

(12) United States Patent
Chuang

(10) Patent No.: US 9,403,054 B1
(45) Date of Patent: Aug. 2, 2016

(54) SITTING TYPE OBLONG ORBITAL EXERCISING MACHINE

(71) Applicant: HIGH SPOT HEALTH TECHNOLOGY CO., LTD., Taichung (TW)

(72) Inventor: Yen-Chi Chuang, Taichung (TW)

(73) Assignee: High Spot Health Technology Co., Ltd., Taichung (TW)

( * ) Notice: Subject to any disclaimer, the term of this patent is extended or adjusted under 35 U.S.C. 154(b) by 0 days.

(21) Appl. No.: 14/693,924

(22) Filed: Apr. 23, 2015

(51) Int. Cl.

| | |
|---|---|
| ***A63B 22/00*** | (2006.01) |
| ***A63B 69/18*** | (2006.01) |
| ***A63B 22/20*** | (2006.01) |
| ***A63B 23/04*** | (2006.01) |
| ***A63B 23/12*** | (2006.01) |

(52) U.S. Cl.
CPC ..... *A63B 22/203* (2013.01); *A63B 23/04* (2013.01); *A63B 23/12* (2013.01)

(58) Field of Classification Search
CPC ..... A63B 22/0002–22/0012; A63B 22/20; A63B 22/201; A63B 22/203; A63B 22/0664; A63B 22/0605; A63B 23/03516; A63B 23/03533; A63B 23/03575; A63B 23/03583; A63B 23/03591; A63B 23/04–23/0429; A63B 23/12; A63B 23/1209; A63B 23/1245; A63B 23/1263; A63B 23/1281; A63B 2022/067; A63B 2202/0676; A63B 2202/0682; A63B 2202/0688; A63B 2023/0411; A63B 2023/0047; A63B 2023/0452
See application file for complete search history.

(56) References Cited

U.S. PATENT DOCUMENTS

| | | | | |
|---|---|---|---|---|
| 6,932,745 | B1 * | 8/2005 | Ellis | A63B 22/0023 482/52 |
| 7,276,017 | B2 * | 10/2007 | Chen | A63B 22/001 482/52 |
| 8,998,775 | B1 * | 4/2015 | Chuang | A63B 22/0664 482/52 |
| 9,067,101 | B1 * | 6/2015 | Chuang | A63B 22/0664 |
| 2004/0259692 | A1 * | 12/2004 | Martin | A63B 22/0007 482/52 |
| 2005/0003932 | A1 * | 1/2005 | Chen | A63B 22/001 482/52 |
| 2008/0167165 | A1 * | 7/2008 | Liao | A63B 22/001 482/52 |
| 2009/0239714 | A1 * | 9/2009 | Sellers | A63B 22/001 482/52 |
| 2011/0028277 | A1 * | 2/2011 | Merli | A63B 22/001 482/63 |
| 2012/0277066 | A1 * | 11/2012 | Hsu | A63B 22/001 482/57 |
| 2014/0243157 | A1 * | 8/2014 | Huang | A63B 22/001 482/52 |

* cited by examiner

*Primary Examiner* — Oren Ginsberg
*Assistant Examiner* — Gregory Winter
(74) *Attorney, Agent, or Firm* — Alan D. Kamrath; Kamrath IP Lawfirm, P.A.

(57) ABSTRACT

An oblong orbital exercising machine includes a main frame, an upright mounted on the main frame, a seat support mounted on the main frame, a cycle movement mechanism mounted between the seat support and the main frame, a seat mounted on the seat support, two guiding tracks mounted on the main frame, two swinging handles pivotally connected with the upright, two drive bars each having a first end pivotally connected with the cycle movement mechanism, two pedal units mounted on a second end of the respective drive bar, two driven bars each having a first end pivotally connected with the respective swinging handle and a second end pivotally connected with the respective drive bar, and two rollers each pivotally connected with the respective driven bar and each movably mounted in the respective guiding track.

10 Claims, 8 Drawing Sheets

SITTING TYPE OBLONG ORBITAL EXERCISING MACHINE

BACKGROUND OF THE INVENTION

1. Field of the Invention

The present invention relates to an exercising machine and, more particularly, to a sitting type exercising machine with an oblong orbit or cycle.

2. Description of the Related Art

A conventional oblong orbital exercising machine comprises a main frame, an upright mounted on a front portion of the main frame, two cranks each having a first end pivotally connected with the upright, two sliding bars each having a first end pivotally connected with a second end of the respective crank, two guiding tracks each mounted on a rear portion of the main frame, two rollers each mounted on a second end of the respective sliding bar and each slidable forward and backward on the respective guiding track, two swinging handles each pivotally connected with the upright, two tread bars each having a first end pivotally connected with a lower end of the respective swinging handle, and two pedals each secured on a second end of the respective tread bar. Each of the tread bars is pivotally connected with the respective sliding bar. However, when each of the rollers is moved on the respective guiding track, each of the rollers is easily deflected rightward or leftward during movement, and is easily detached from the respective guiding track due to a higher speed.

BRIEF SUMMARY OF THE INVENTION

In accordance with the present invention, there is provided an oblong orbital exercising machine comprising a main frame, an upright mounted on a front portion of the main frame, a seat support mounted on a rear portion of the main frame, a cycle movement mechanism mounted between the seat support and the main frame, a seat mounted on the seat support, two guiding tracks each mounted on the main frame, two swinging handles each pivotally connected with the upright, two drive bars each having a first end pivotally connected with the cycle movement mechanism, two pedal units each mounted on a second end of the respective drive bar, two driven bars each having a first end pivotally connected with the respective swinging handle and a second end pivotally connected with the respective drive bar, and two rollers each pivotally connected with the respective driven bar and each movably mounted in the respective guiding track. Each of the pedal units includes a fixing plate secured on the second end of the respective drive bar and provided with two elongate slots, a rocking plate pivotally connected with the second end of the respective drive bar, two springs biased between the fixing plate and the rocking plate, two fastening rods secured on the rocking plate and extending through the springs and the elongate slots of the fixing plate, and a pedal secured on the rocking plate.

According to the primary advantage of the present invention, the driven bars are directly driven by the swinging handles so that the driven bars are moved smoothly and stably and will not vibrate leftward and rightward during a long-term utilization.

According to another advantage of the present invention, the rollers are covered by the guiding tracks so that the rollers slide in the guiding tracks solidly and stably without incurring deflection, detachment or vibration.

According to a further advantage of the present invention, the guiding tracks 40 are arranged at the middle position of the main frame to enhance the operational safety and the aesthetic quality of the oblong orbital exercising machine.

According to a further advantage of the present invention, the springs of each of the pedal units provide an elastic force to the pedal, so that when the pedal units are moved in concert with the drive bars to perform an oblong orbital movement, the pedal of each of the pedal units is moved and adjusted forward and backward to correspond to the oblong trace of movement.

According to a further advantage of the present invention, the optimum angle between the fixing plate of each of the pedal units and the ground is ranged between 55° and 75° to satisfy the ergonomically designed requirement, so that when the pedal of each of the pedal units is moved to the foremost position, the user's feet can tread the pedal of each of the pedal units exactly and comfortably.

According to a further advantage of the present invention, the fastening rods are slidable in the elongate slots of the fixing plate to increase the swinging movement extent of the pedal, so that the pedal of each of the pedal units is pivoted largely relative to the fixing plate to facilitate the user treading and swinging the pedal of each of the pedal units.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
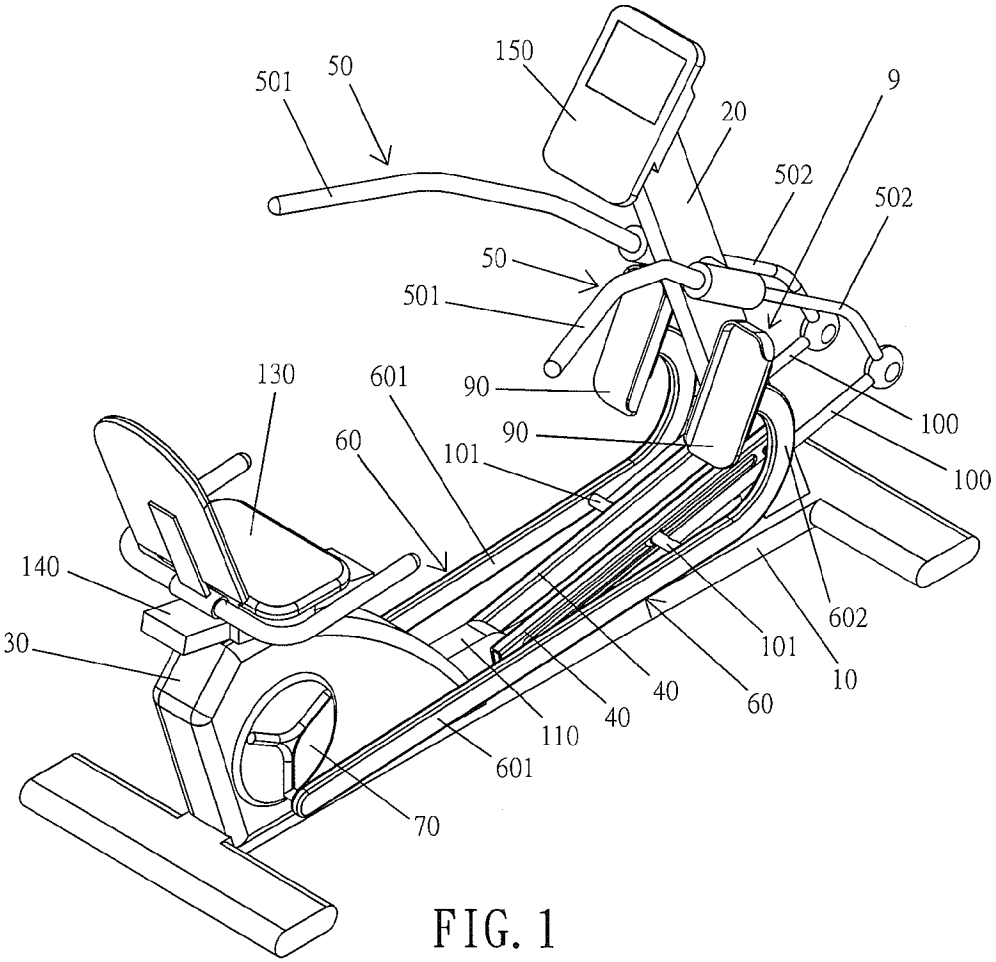
FIG. 1 is a perspective view of an oblong orbital exercising machine in accordance with the preferred embodiment of the present invention.
Figure 2:
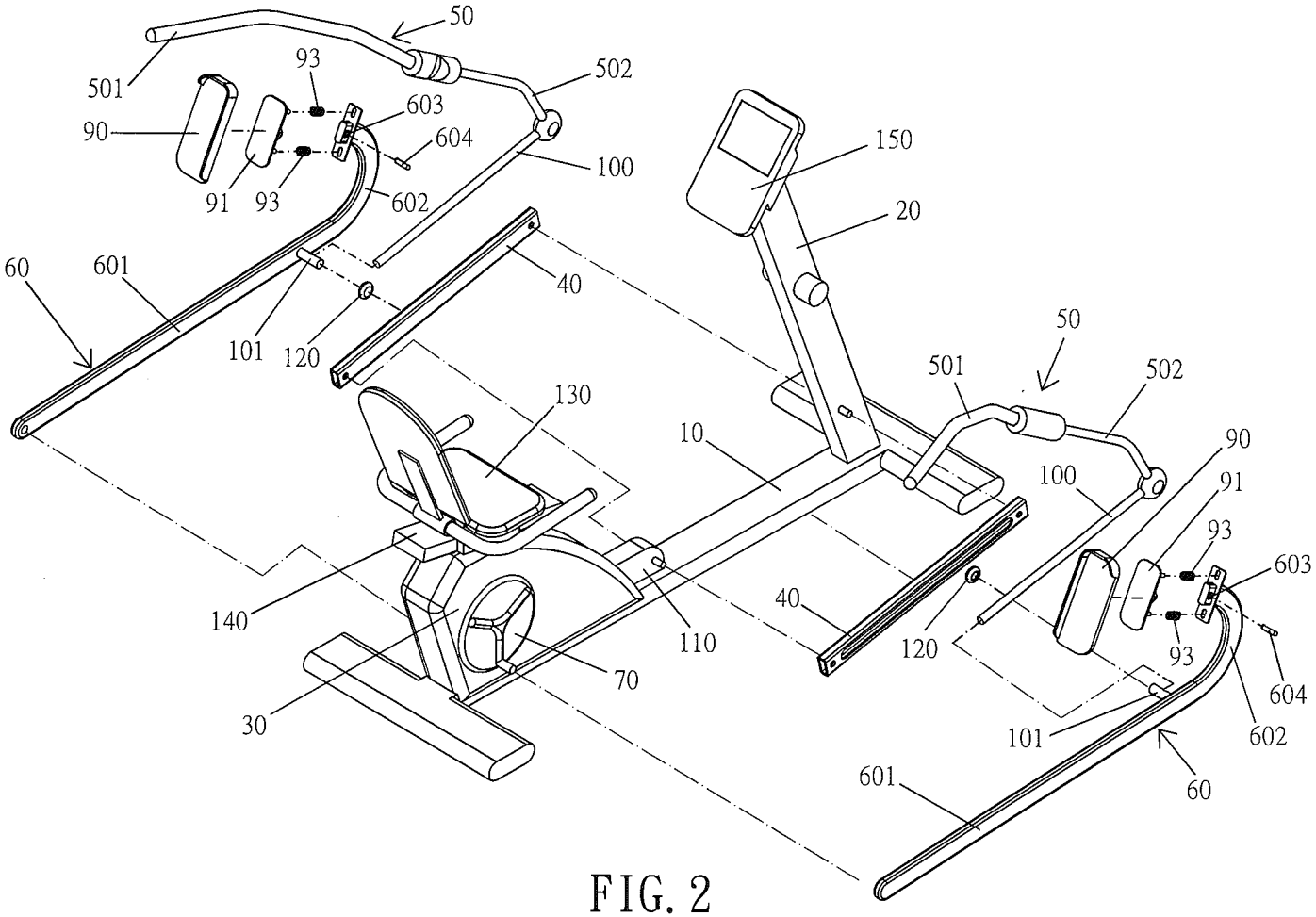
FIG. 2 is an exploded perspective view of the oblong orbital exercising machine as shown in FIG. 1.
Figure 3:
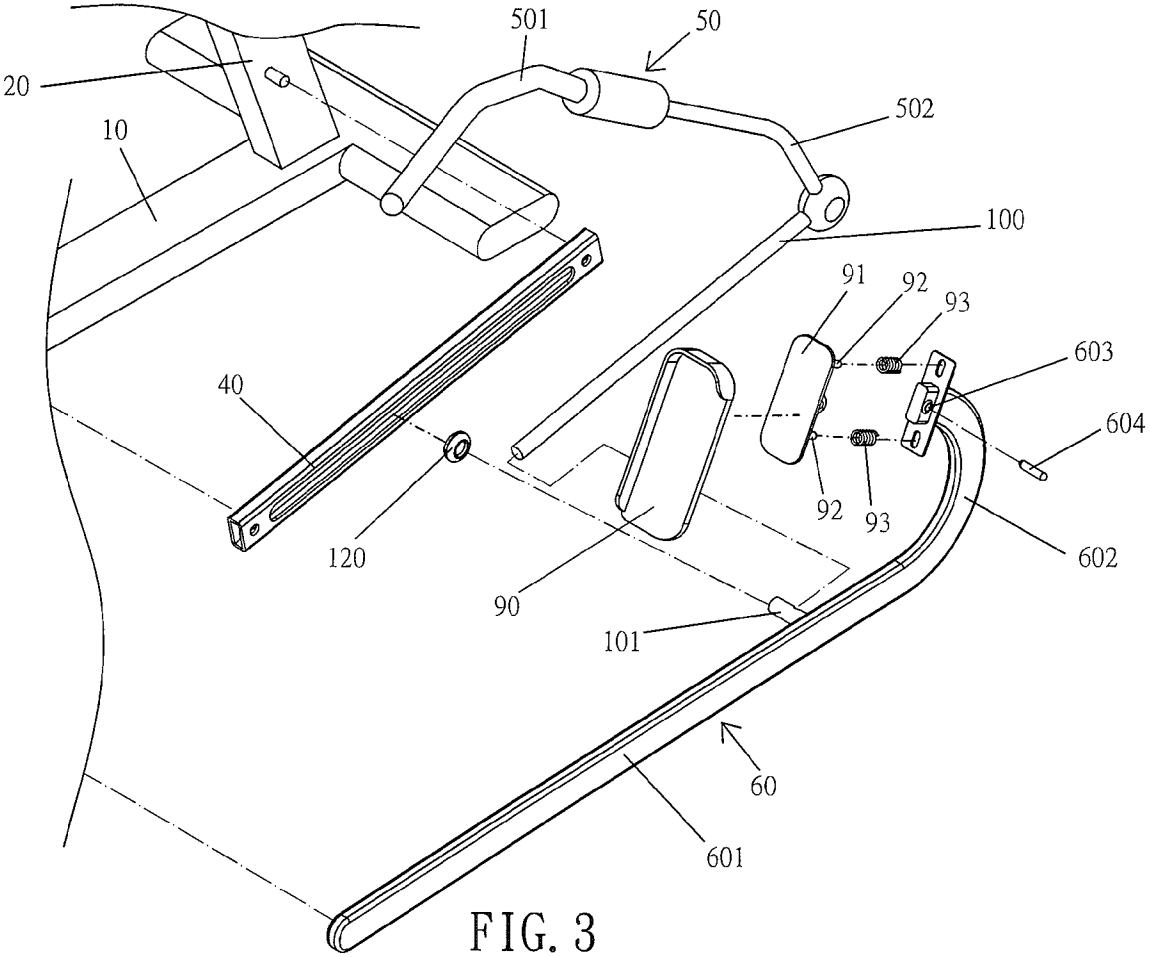
FIG. 3 is a locally enlarged view of the oblong orbital exercising machine as shown in FIG. 2.
Figure 4:
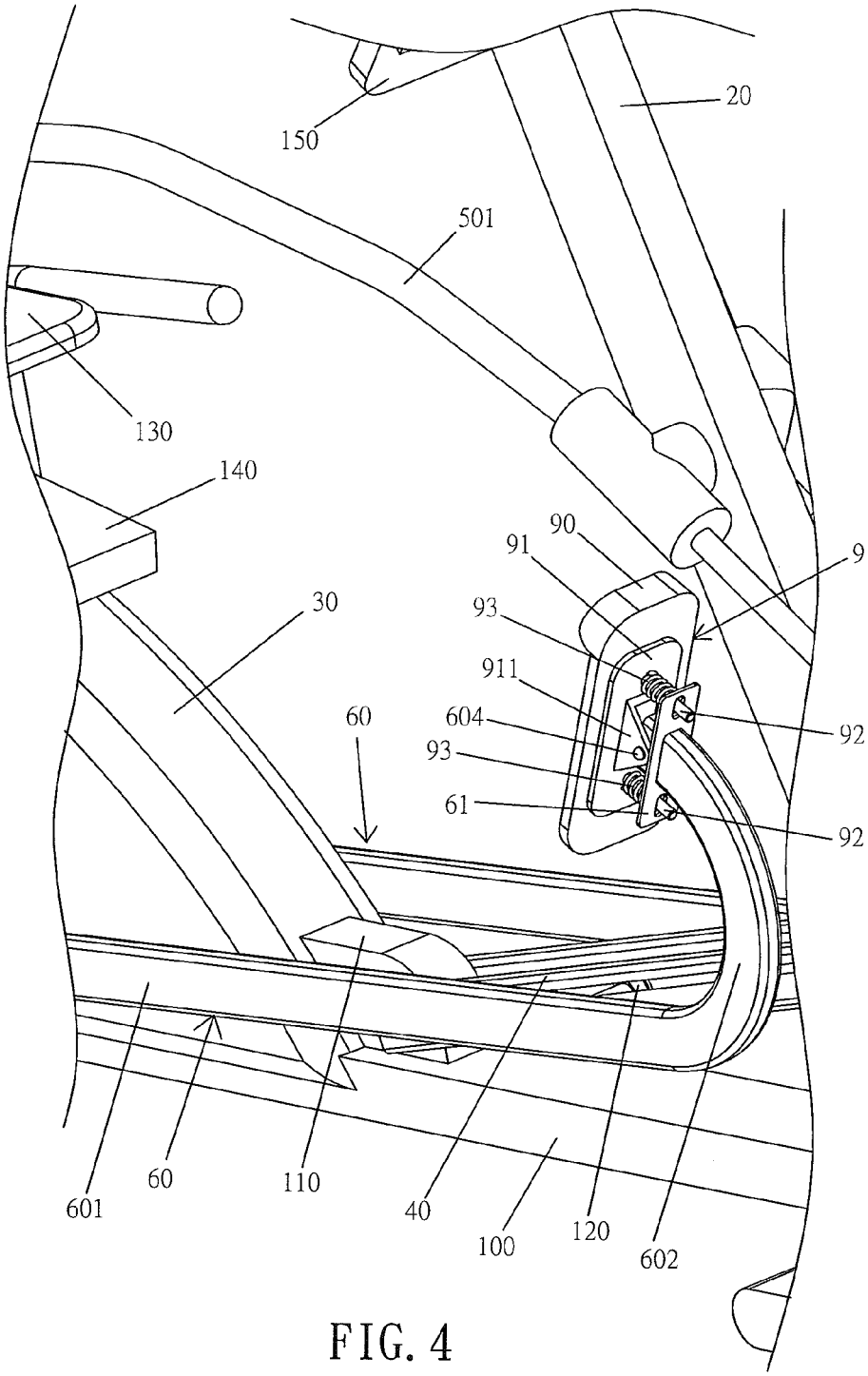
FIG. 4 is a locally enlarged front perspective view of the oblong orbital exercising machine as shown in FIG. 1.
Figure 5:
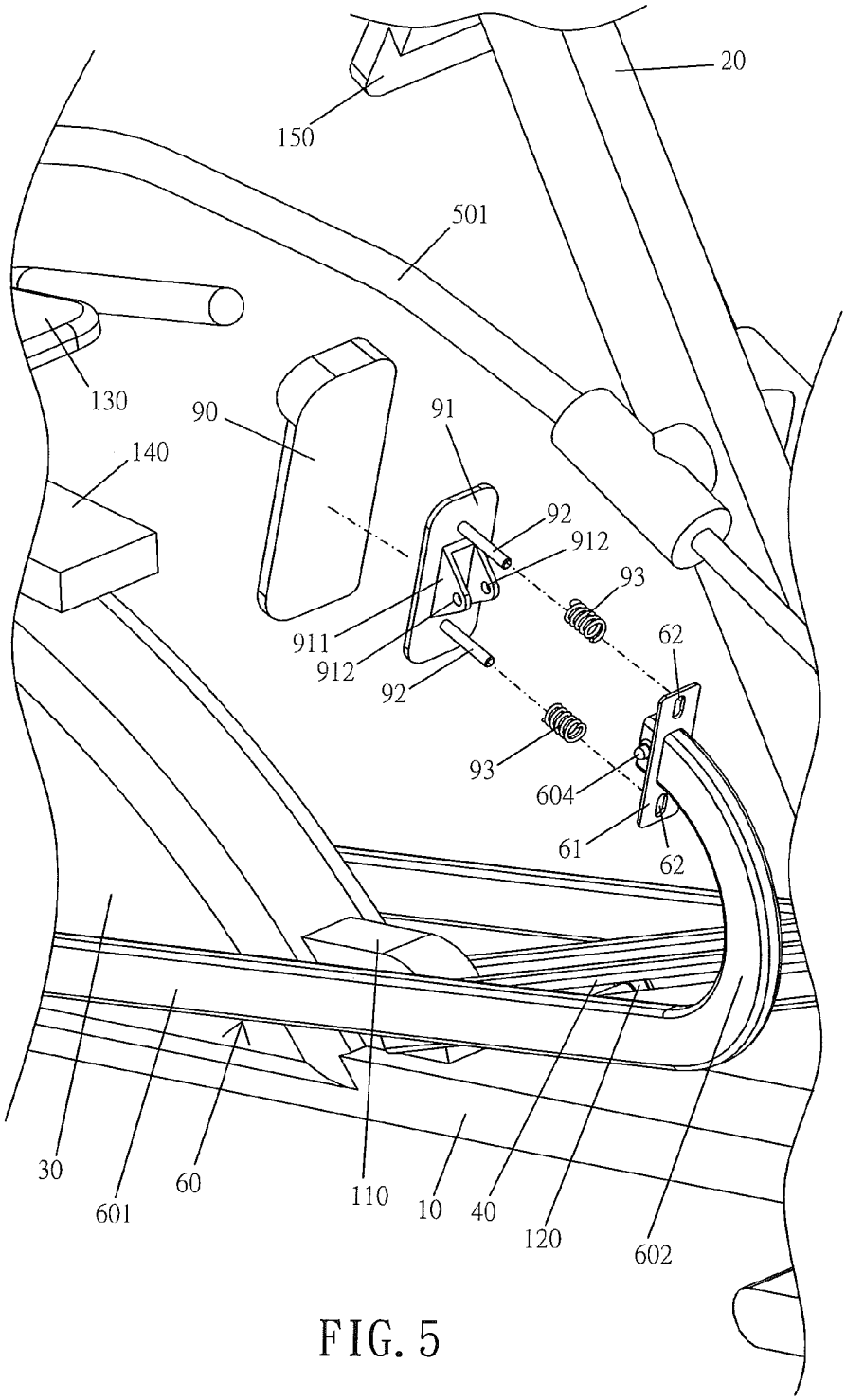
FIG. 5 is a partially exploded perspective view of the oblong orbital exercising machine as shown in FIG. 4.

Referring to the drawings and initially to FIGS. 1-5, an oblong orbital exercising machine in accordance with the preferred embodiment of the present invention comprises a main frame 10, an upright 20 mounted on a front portion of the main frame 10, a seat support 30 mounted on a rear portion of the main frame 10, a cycle movement mechanism 70 mounted between the seat support 30 and the main frame 10, a seat 130 mounted on the seat support 30, two guiding tracks 40 each mounted on the main frame 10, two swinging handles 50 each pivotally connected with the upright 20, two drive bars 60 each having a first end pivotally connected with the cycle movement mechanism 70, two pedal units 9 each mounted on a second end of the respective drive bar 60, two driven bars 100 each having a first end pivotally connected with the respective swinging handle 50 and a second end pivotally connected with the respective drive bar 60, and two rollers 120 each pivotally connected with the respective driven bar 100 and each movably mounted in the respective guiding track 40.

The main frame 10 is provided with a fixing base 110. The seat support 30 has s top provided with a slide track 140. The seat 130 has a bottom slidably mounted on the slide track 140. The upright 20 has an upper end provided with an instrument panel 150. The guiding tracks 40 are arranged on the main frame 10 in an inclined manner. Each of the guiding tracks 40 has a first end secured on the upright 20 and a second end secured on the fixing base 110 of the main frame 10. Each of the guiding tracks 40 has a substantially C-shaped cross-sectional profile. The swinging handles 50 are arranged on two opposite sides of the upright 20. Each of the swinging handles 50 includes an upper grip portion 501 and a lower elastic portion 502 connected with the upper grip portion 501. The lower elastic portion 502 of each of the swinging handles 50 is flexible relative to the upper grip portion 501.

The drive bars 60 are arranged on two opposite sides of the cycle movement mechanism 70. The second end of each of the drive bars 60 is provided with a through hole 603. Each of the drive bars 60 includes a straight section 601 and a curved section 602. The curved section 602 of each of the drive bars 60 has a substantially U-shaped profile. The first end of each of the driven bars 100 is pivotally connected with a lower end of the lower elastic portion 502 of the respective swinging handle 50. The second end of each of the driven bars 100 is pivotally connected with the straight section 601 of the respective drive bar 60. The second end of each of the driven bars 100 is provided with a transverse connecting rod 101 which is pivotally connected with the respective roller 120 and the respective drive bar 60.

Each of the pedal units 9 is pivotally connected with the curved section 602 of the respective drive bar 60. Each of the pedal units 9 includes a fixing plate 61 secured on the second end of the respective drive bar 60 and provided with two elongate slots 62, a rocking plate 91 pivotally connected with the second end of the respective drive bar 60, two springs 93 biased between the fixing plate 61 and the rocking plate 91, two fastening rods 92 secured on the rocking plate 91 and extending through the springs 93 and the elongate slots 62 of the fixing plate 61, and a pedal 90 secured on the rocking plate 91.

The fixing plate 61 of each of the pedal units 9 is secured on the curved section 602 of the respective drive bar 60 and is perpendicular to the respective drive bar 60. The fixing plate 61 of each of the pedal units 9 is inclined relative to the ground, and an angle between the fixing plate 61 of each of the pedal units 9 and the ground is ranged between 55° and 75°. The rocking plate 91 of each of the pedal units 9 is provided with two pivot ears 911 mounted on the second end of the respective drive bar 60. Each of the pivot ears 911 of each of the pedal units 9 is provided with a through bore 912, and each of the pedal units 9 further includes a pivot member 604 extending through the through bore 912 of each of the pivot ears 911 and the through hole 603 of the respective drive bar 60, so that the pivot ears 911 of each of the pedal units 9 is pivotally connected with the second end of the respective drive bar 60.

Figure 6:
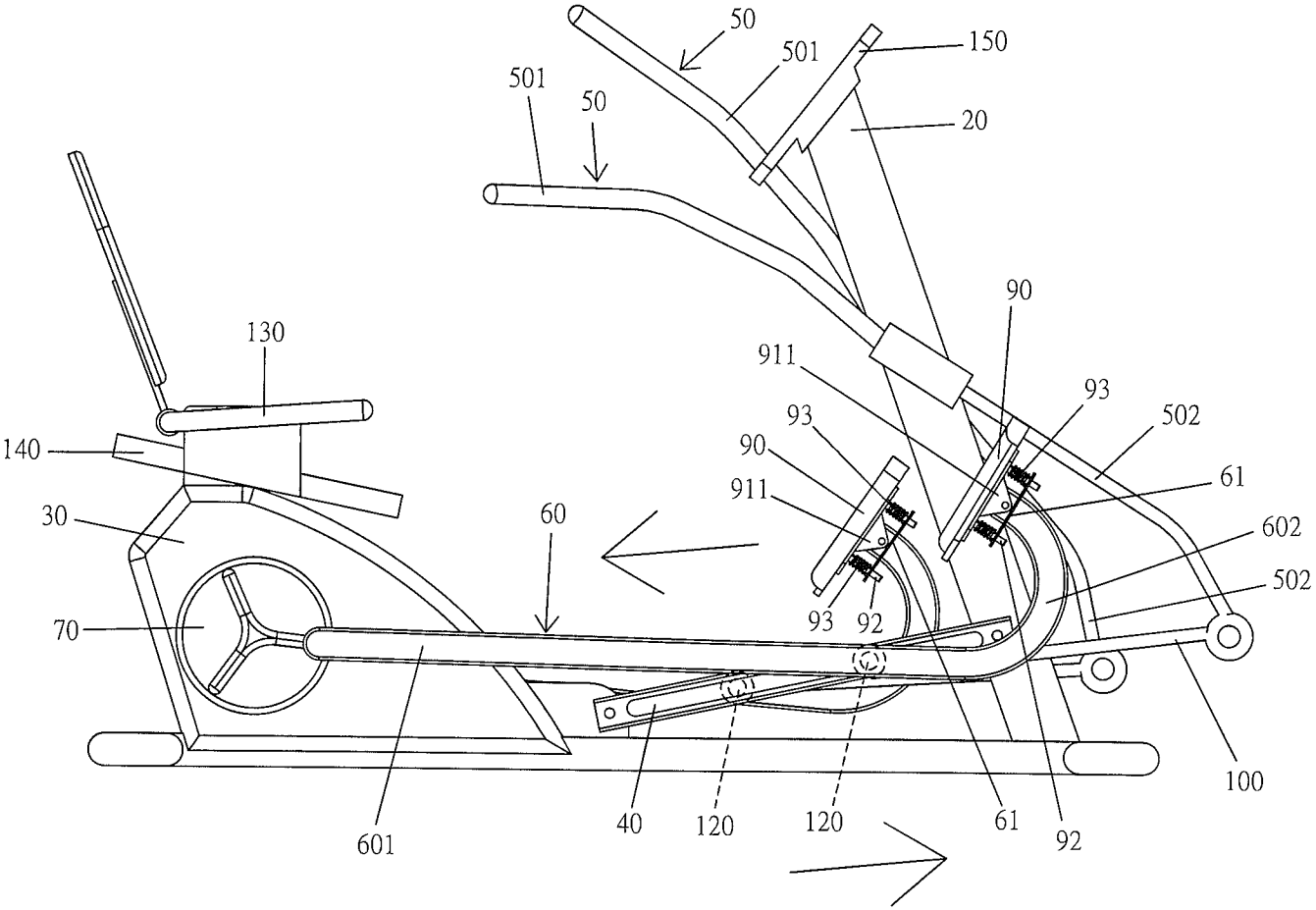
FIG. 6 is a side operational view of the oblong orbital exercising machine as shown in FIG. 1.
Figure 7:
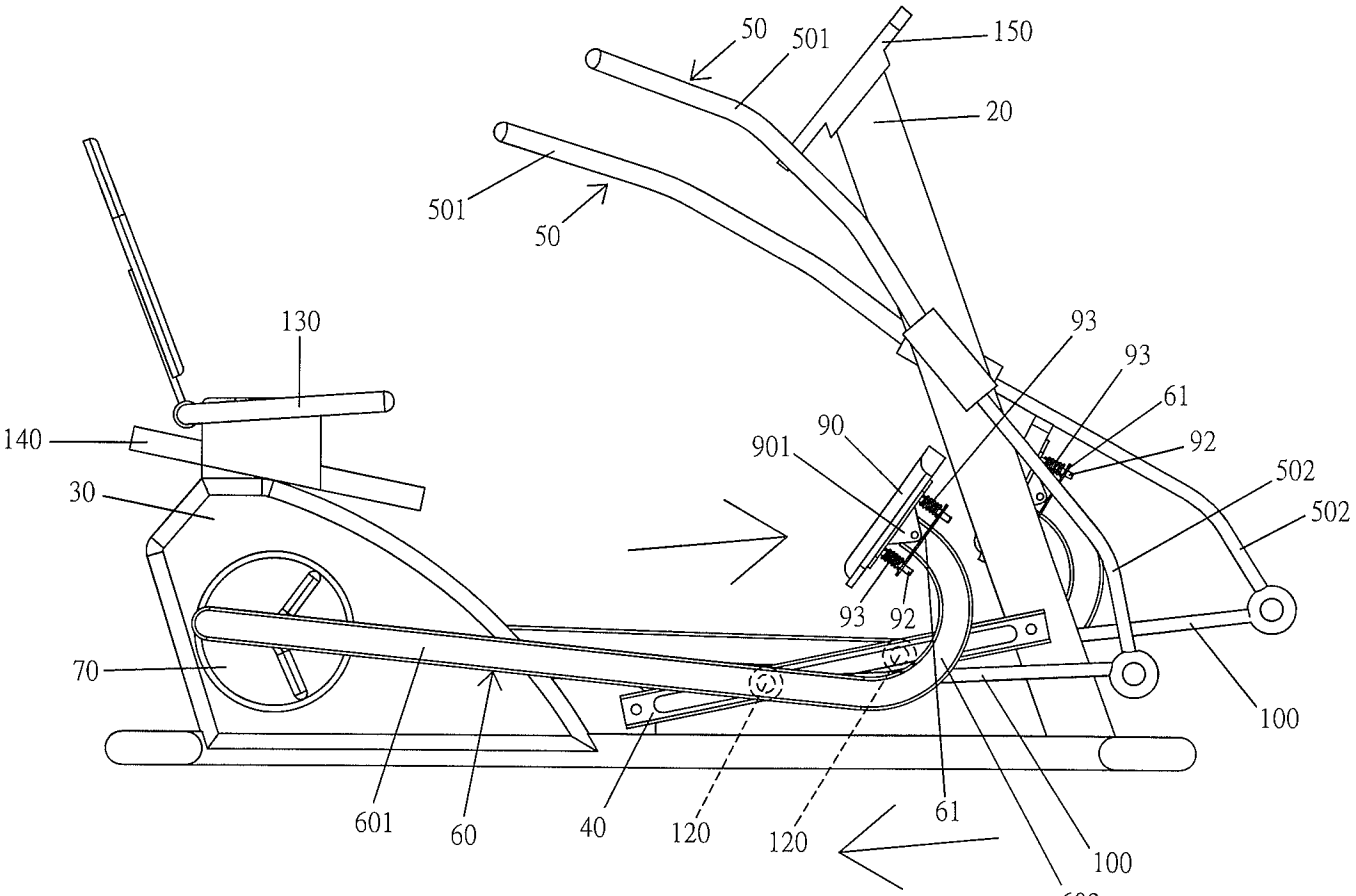
FIG. 7 is another side operational view of the oblong orbital exercising machine as shown in FIG. 1.
Figure 8:
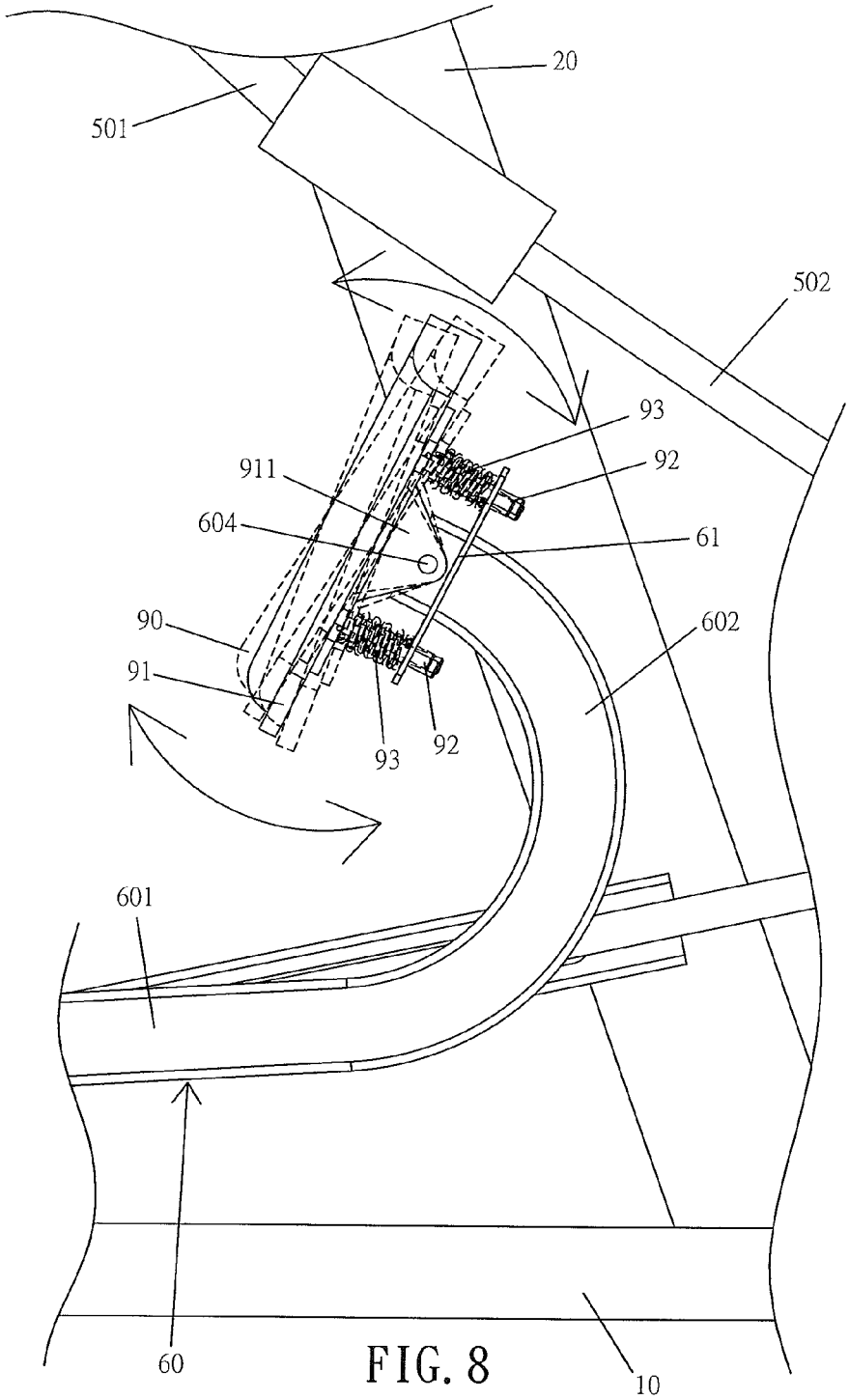
FIG. 8 is a locally enlarged side operational view of the oblong orbital exercising machine as shown in FIG. 1.

In operation, referring to FIGS. 6-8 with reference to FIGS. 1-5, a user is seated on the seat 130, with his/her hands holding and moving the upper grip portions 501 of the swinging handles 50, and with his/her feet treading the pedals 90 of the pedal units 9, so that the drive bars 60 and the driven bars 100 are driven and moved, and the rollers 120 are driven synchronously to slide in the guiding tracks 40 forward and backward as shown in FIGS. 6 and 7. At the same time, the drive bars 60 drive the cycle movement mechanism 70 to rotate. In addition, when the pedal units 9 are moved in concert with the drive bars 60, the springs 93 of each of the pedal units 9 are biased between the fixing plate 61 and the rocking plate 91 to provide a buffering effect to the pedal 90.

Accordingly, the driven bars 100 are directly driven by the swinging handles 50 so that the driven bars 100 are moved smoothly and stably and will not vibrate leftward and rightward during a long-term utilization. In addition, the rollers 120 are covered by the guiding tracks 40 so that the rollers 120 slide in the guiding tracks 40 solidly and stably without incurring deflection, detachment or vibration. Further, the guiding tracks 40 are arranged at the middle position of the main frame 10 to enhance the operational safety and the aesthetic quality of the oblong orbital exercising machine. Further, the springs 93 of each of the pedal units 9 provide an elastic force to the pedal 90, so that when the pedal units 9 are moved in concert with the drive bars 60 to perform an oblong orbital movement, the pedal 90 of each of the pedal units 9 is moved and adjusted forward and backward to correspond to the oblong trace of movement. Further, the optimum angle between the fixing plate 61 of each of the pedal units 9 and the ground is ranged between 55° and 75° to satisfy the ergonomically designed requirement, so that when the pedal 90 of each of the pedal units 9 is moved to the foremost position, the user's feet can tread the pedal 90 of each of the pedal units 9 exactly and comfortably. Further, the fastening rods 92 are slidable in the elongate slots 62 of the fixing plate 61 to increase the swinging movement extent of the pedal 90, so that the pedal 90 of each of the pedal units 9 is pivoted largely relative to the fixing plate 61 as shown in FIG. 8 to facilitate the user treading and swinging the pedal 90 of each of the pedal units 9.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An oblong orbital exercising machine comprising:

a main frame;

an upright mounted on a front portion of the main frame;

a seat support mounted on a rear portion of the main frame;

a cycle movement mechanism mounted between the seat support and the main frame;

a seat mounted on the seat support;

two guiding tracks each mounted on the main frame;

two swinging handles each pivotally connected with the upright;

two drive bars each having a first end pivotally connected with the cycle movement mechanism;

two pedal units each mounted on a second end of the respective drive bar;

two driven bars each having a first end pivotally connected with the respective swinging handle and a second end pivotally connected with the respective drive bar; and two rollers each pivotally connected with the respective driven bar and each movably mounted in the respective guiding track;

wherein:

each of the pedal units includes:

a fixing plate secured on the second end of the respective drive bar and provided with two elongate slots;

a rocking plate pivotally connected with the second end of the respective drive bar;

two springs biased between the fixing plate and the rocking plate;

two fastening rods secured on the rocking plate and extending through the springs and the elongate slots of the fixing plate; and a pedal secured on the rocking plate.

2. The oblong orbital exercising machine of claim 1, wherein the upright has an upper end provided with an instrument panel.

3. The oblong orbital exercising machine of claim 1, wherein:

the guiding tracks are arranged on the main frame in an inclined manner;

the main frame is provided with a fixing base; and each of the guiding tracks has a first end secured on the upright and a second end secured on the fixing base of the main frame.

4. The oblong orbital exercising machine of claim 1, wherein:

the swinging handles are arranged on two opposite sides of the upright;

each of the swinging handles includes an upper grip portion and a lower elastic portion connected with the upper grip portion;

the lower elastic portion of each of the swinging handles is flexible relative to the upper grip portion; and the first end of each of the driven bars is pivotally connected with a lower end of the lower elastic portion of the respective swinging handle.

5. The oblong orbital exercising machine of claim 1, wherein:

the drive bars are arranged on two opposite sides of the cycle movement mechanism;

each of the drive bars includes a straight section and a curved section;

the curved section of each of the drive bars has a substantially U-shaped profile;

the second end of each of the driven bars is pivotally connected with the straight section of the respective drive bar; and each of the pedal units is pivotally connected with the curved section of the respective drive bar.

6. The oblong orbital exercising machine of claim 1, wherein:

the second end of each of the drive bars is provided with a through hole;

the rocking plate of each of the pedal units is provided with two pivot ears mounted on the second end of the respective drive bar;

each of the pivot ears of each of the pedal units is provided with a through bore; and each of the pedal units further includes a pivot member extending through the through bore of each of the pivot ears and the through hole of the respective drive bar.

7. The oblong orbital exercising machine of claim 1, wherein:

the fixing plate of each of the pedal units is perpendicular to the respective drive bar; and the fixing plate of each of the pedal units is inclined relative to the ground, and an angle between the fixing plate of each of the pedal units and the ground is ranged between 55° and 75°.

8. The oblong orbital exercising machine of claim 1, wherein each of the guiding tracks has a substantially C-shaped cross-sectional profile.

9. The oblong orbital exercising machine of claim 1, wherein the second end of each of the driven bars is provided with a transverse connecting rod which is pivotally connected with the respective roller and the respective drive bar.

10. The oblong orbital exercising machine of claim 1, wherein:

the seat support has a top provided with a slide track; and the seat has a bottom slidably mounted on the slide track.

* * * * *